United States Patent [19]

Estkowski et al.

[11] Patent Number: 5,018,787

[45] Date of Patent: May 28, 1991

[54] CHAIR SEAT TILT CONTROL

[75] Inventors: Michael H. Estkowski, St. Joseph; Don E. Minor, Coloma, both of Mich.

[73] Assignee: Shepherd Products U.S. Inc., St. Joseph, Mich.

[21] Appl. No.: 540,767

[22] Filed: Jun. 20, 1990

[51] Int. Cl.[5] ..... A47C 3/00

[52] U.S. Cl. ..... 297/302; 297/301; 297/304

[58] Field of Search ..... 292/302, 304, 300, 301, 292/326; 248/575

[56] References Cited

U.S. PATENT DOCUMENTS

| | | | |
|---|---|---|---|
| 1,510,275 | 9/1929 | Hearsch | 297/302 X |
| 2,991,125 | 7/1961 | Lie . | |
| 3,131,904 | 5/1964 | Lie . | |
| 3,480,249 | 11/1969 | Lie . | |
| 3,592,433 | 7/1971 | Fuhrman . | |
| 3,740,792 | 6/1973 | Werner . | |
| 3,868,144 | 2/1975 | Lie . | |
| 4,295,626 | 10/1981 | Large . | |
| 4,479,679 | 10/1984 | Fries et al. . | |
| 4,653,806 | 3/1987 | Willi . | |
| 4,718,726 | 1/1988 | Estkowski et al. | 297/303 X |
| 4,744,600 | 5/1988 | Inoue . | |
| 4,763,950 | 8/1988 | Tobler | 297/304 X |
| 4,773,706 | 9/1988 | Hinrichs . | |
| 4,787,673 | 11/1988 | Locher | 297/301 |
| 4,892,354 | 6/1990 | Estkowski et al. | 297/302 x |
| 4,943,115 | 7/1990 | Stucki | 297/301 |

FOREIGN PATENT DOCUMENTS

| | | | |
|---|---|---|---|
| 3616475 | 6/1987 | Fed. Rep. of Germany | 297/302 |

*Primary Examiner*—José V. Chen

*Attorney, Agent, or Firm*—Lee, Mann, Smith, McWilliams & Sweeney

[57] ABSTRACT

A seat support mechanism for a tiltable chair having a rear tilt torque mechanism including interconnected torsion bars which are adjustable to vary the resilient restraining force which opposes rearward tilt of the seat when occupied, a pair of compression springs disposed between a seat support assembly and a base member to provide added resistance to rearward tilt, a link to limit rotation of the seat support assembly within predetermined limits and a release mechanism movable between a lock position, wherein rearward tilt is prohibited and a release position, wherein rearward tilt is permitted.

6 Claims, 2 Drawing Sheets

CHAIR SEAT TILT CONTROL

BACKGROUND OF THE INVENTION

The present invention is directed to a seat support mechanism for a tiltable chair utilizing interconnected torsion bars to vary the resistance to rearward tilt. Numerous arrangements of this general type are shown in the prior art U.S. Pat. Nos. 2,991,125, 3,131,904, 3,480,249, 3,592,433, 3,740,792, 3,868,144, 4,295,626, 4,479,679, 4,653,806, 4,718,726, 4,744,600, 4,773,706 and 4,892,354. None of these patents discloses the features of the present invention.

SUMMARY OF THE INVENTION

The present invention provides a support mechanism for a tiltable chair including a seat support assembly mounted to the underside of a chair seat. The support assembly includes a pair of side plates. A tube is supported between the front ends of the side plates and is relatively rotatable therewith. A base member, having a rear end adapted to be supported by a chair post and a front end which is rigidly attached about the tube, is also provided. A rear tilt torque mechanism, operative to resist rear tilt of the seat support assembly about the tube, is associated with the seat support assembly. Rear tilt torque adjustment means is connected to the rear tilt torque mechanism to selectively vary the resistance to rear tilt. At least one compression spring is biased between the seat support assembly and the base member. The spring operates to provide added resistance to rear tilt of the seat about the tube. A connecting link has one end pivotally connected to the support assembly and the other end slidably connected to the base member. The connecting link acts to limit rotation of the support assembly about the tube within predetermined limits. A release mechanism is associated with the connecting link to lock it in a first position, whereby rear tilt of the support assembly is prohibited and to selectively release the link to assume a second position, whereby limited rear tilt of the support assembly about the tube is permitted.

DETAILED DESCRIPTION OF THE INVENTION

Figures 3, 4:
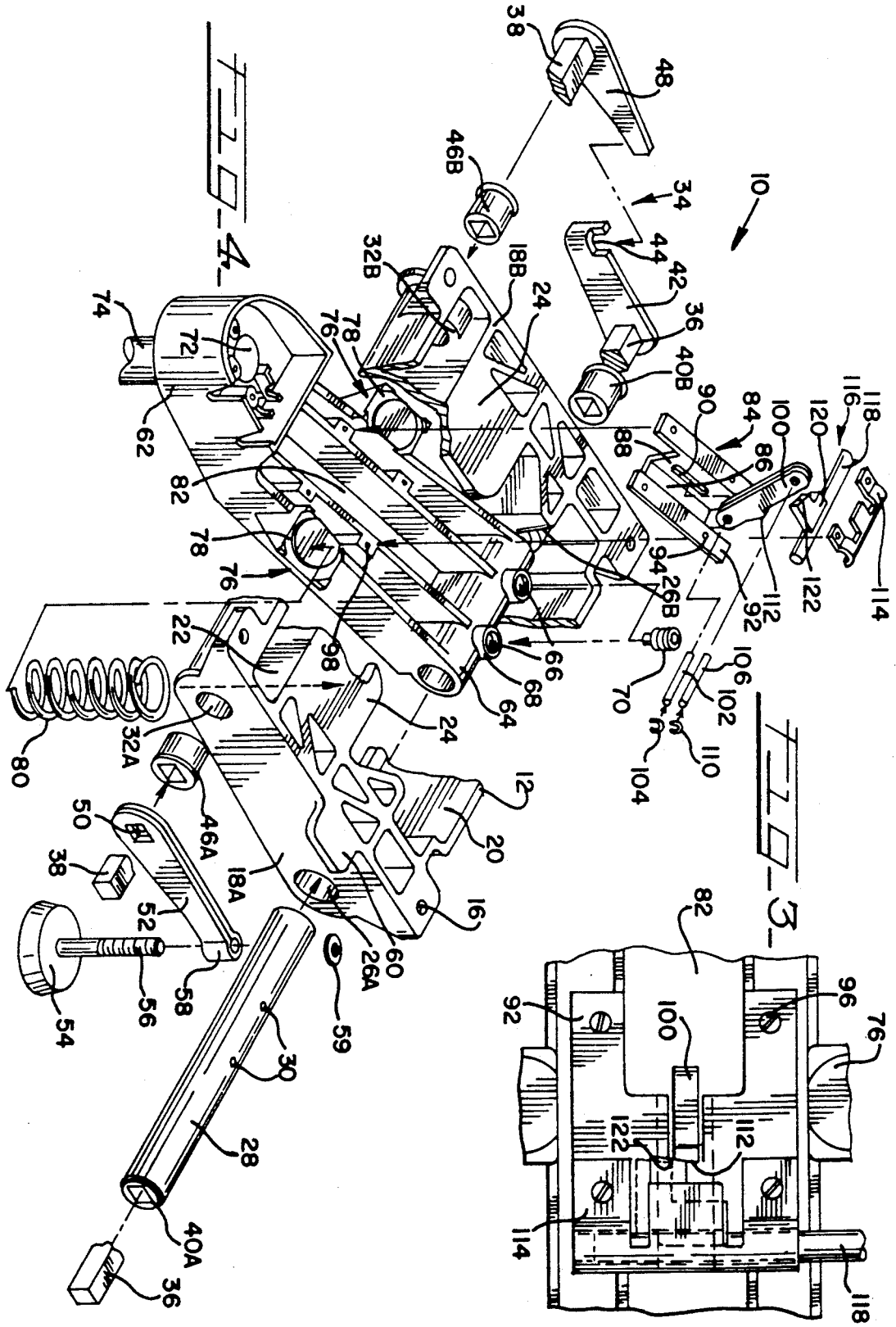
FIG. 3 is a top view showing the link and release mechanism of the present invention.
FIG. 4 is an exploded perspective view showing the elements of the support mechanism of the present invention.

A support mechanism for a tiltable chair is shown in FIGS. 1–4 of the drawings. The support mechanism, generally designated by the numeral 10, includes a seat support assembly 12 which is mounted via apertures 16 provided therein to the underside of a chair seat 14, shown in FIG. 1. The seat support assembly 12 includes a pair of side plates 18A and 18B which are joined at their front ends by a generally J-shaped support 20. Their rear ends are joined by a generally U-shaped support 22. As best seen in FIG. 4, an outwardly extending flange 24 is defined at the juncture of each rear end of the side plates 18A and 18B and the U-shaped channel 22. The purpose of these flanges 24 will be more fully described below. A pair of sleeves 26A and 26B are formed at the front ends of the side plates 18A and 18B. A tube 28 having a central axis is rotatably positioned within the sleeves 26A and 26B. A pair of apertures 30 are formed in the tube 28. Each end of the U-shaped channel defines a sleeve 32A, 32B.

A rear tilt torque mechanism, best shown in FIG. 4 and generally designated by the numeral 34, includes a first torsion bar 36 and a second torsion bar 38. The first torsion bar 36 extends through the tube 28. One end of the first torsion bar 36 is non-rotatably supported in a bushing 40A integrally formed in one end of the tube 28. The other end of the first torsion bar 36 is rotatably supported within sleeve 32B by means of a bushing 40B. The end of the first torsion bar 36 which is rotatably supported in the bushing 40B extends outwardly therefrom and is secured in a first bracket 42, as best seen in FIG. 4. The first bracket 42 defines a bend at its free end through which a slot 44 is formed.

The second torsion bar 38 is rotatably supported within the U-shaped channel 22 by bushing 46A, which is rotatably supported in sleeve 32A and bushing 46B which is rotatably supported in sleeve 32B. One end of torsion bar 38 extends outwardly from the bushing 46B and is secured to a second bracket 48. The free end of bracket 48 is adapted to fit in the slot 44 so that the brackets 42 and 48 are interconnected. The other end of the second torsion bar 38 extends outwardly from the bushing 46A and is secured in an aperture 50 defined in a lever 52, which lever 52 is rotatable with the second torsion bar 38. An adjustment knob 54 is provided with an outwardly-extending threaded element 56 which is threadably received within a collar 58 defined at the free end of the lever 52.

A flat washer 59 is disposed about the tip of the element 56 and adjacent the underside of a flange 60 extending outwardly from the top of the side plate 18A to prevent the tip from contacting the flange 60. The washer 59 provides a sliding surface between the flange 60 and the element 56 so that the tip of the element 56 does not gouge the underside of the flange 60.

When the knob 54 is rotated, the threaded element 56 advances within the collar 58 to press the washer 59 into engagement with the underside of the flange 60. Engagement of the second bracket 48 with the first bracket 42 opposes rear pivot of the support assembly 12 about the tube 28. The load exerted on the seat 14 and the torsion characteristic of the first and second torsion bars 36 and 38 determine the extent to which rotation takes place.

The support assembly 12 is mounted upon a base member 62. A cylindrical sleeve 64 is provided at the front end of the base member 62 and is adapted to receive the tube 28. A pair of apertures 66 are provided through the sleeve 64, which apertures 66 have an annular collar 68 concentric therewith and extending outwardly from the sleeve 64. The sleeve apertures 66 are sized and spaced to correspond with the tube apertures 30. The base member 62 is rigidly secured to the tube 28 by means of setscrews 70 which are threaded through the sleeve apertures 66 and into the tube apertures 30.

An opening 72 is provided through the rear portion of the base member 62 to receive a chair post 74 which furnishes primary support for the chair seat 14. The chair post 74 is usually supported at its lower end by some form of pedestal (not shown). A relatively rigid support for the base member 62 and its connected components is provided by the rigid connection between the chair post 74 and the base member 62.

As best seen in FIG. 4, each side of the base member 62 defines an integral, outwardly-extending flange member 76. A generally circular platform 78 is defined on each flange member 76. The base member flanges are positioned in substantial alignment with the support member flanges 24 to provide upper and lower support plates. A pair of compression springs 80 are positioned between the support member flanges 24 and the base member flanges 76. The compression springs 80 provide added resistance to rear tilt. Interchangeable compression springs of differing rates and loads may be utilized to vary the mount of resistance. The use of compression springs allows the chair to accommodate a wider range of occupant weights without having to increase the cross-section and length of the torsion bars 36 and 38 of the rear tilt torque mechanism 34, an arrangement which is undesirable.

A recess or channel 82 is formed in the base member 62. A housing, generally designated by numeral 84, is secured within the recess 82. The housing 84 includes a bottom wall 86 and a pair of side walls 88. Each side wall 88 defines a corresponding opposing slot 90 therethrough. Each side wall 88 also defines an outwardly extending flange 92 having apertures 94 defined therethrough. The housing 84 is secured within the base recess 82 by means of screws 96 which are inserted through the apertures 94 and into corresponding apertures 98 defined in base member 62.

A connecting or tie-down link 100 is connected between the seat support assembly 12 and the base member 62 to limit rotation of the support assembly 12 about the tube 28 within predetermined limits. The lower end of the connecting link 100 is mounted on a pin 102, the ends of which 102 are slidably disposed within the slots 90. Clips 104, secured to each end 102 of the pin 102, retain it in position within the side wall slots 90. The upper end of the link 100 is mounted on a second cylindrical pin 106 between a pair of flanges 108 which depend outwardly from the front side of the U-shaped channel 22 of the support assembly 12. Clips 110 secure the second pin 106 between the flanges 108.

Figure 1:
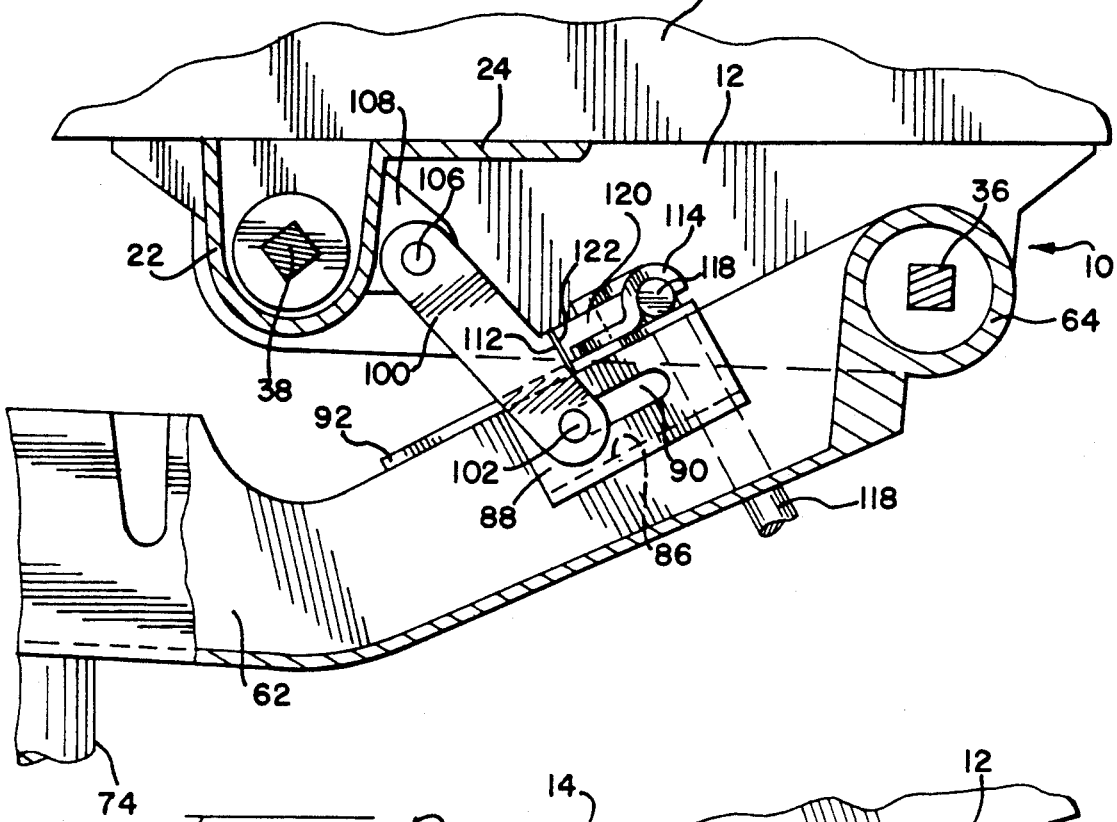
FIG. 1 is a side section of the support mechanism in the unloaded position.
Figure 2:
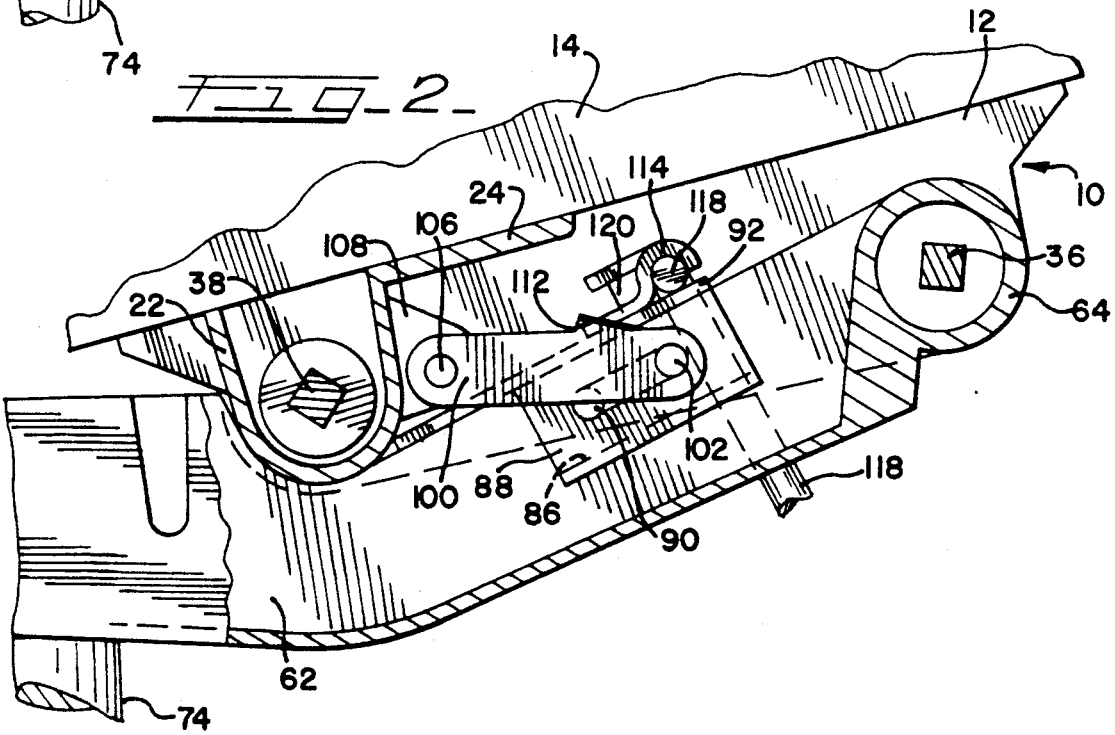
FIG. 2 is a side section of the support mechanism in the loaded rear tilt position.

As best seen in FIGS. 1 and 2 the connecting link 100 defines an angular protrusion 112 extending outwardly from the front side of the connecting link 100. A retention bracket 114 is secured to the flanges 92 of the connecting link housing 84 in which a release mechanism 116 is slidably disposed. The release mechanism 116 includes a wand 118 defining a stop member 120 at the end thereof. As seen in FIGS. 3 and 4, the stop member 120 includes an angled lock surface 122. The stop member 120 is movable between a first lock position, shown in FIG. 3, and a second release position, shown in phantom in FIG. 3.

FIG. 1 illustrates the support mechanism 10 of the present invention in the normal, unloaded, upright position. When the stop member 120 is moved to the lock position, the lock surface 122 contacts the full surface of the protrusion 112. This full surface contact between the lock surface 122 and the link protrusion 112 reduces unit loading of the contact surfaces and eliminates all excess clearance by driving the connecting link 100 firmly back into the slots 90, as shown in FIG. 1 of the drawings. The only clearances that now contribute to chair seat movement are those required to allow the mechanism 10 to operate, that is, where the pin 106 pivotally connects the connecting link 100 to the seat support assembly 12 and where the pin 102 pivotally and slidably connects the lower portion of the connecting link 100 with the housing 84. In this position, rear tilt of the seat support assembly 12 about the tube 28 is prohibited.

When the stop member 120 is moved to the release position, the pin 102 is free to slide forward in the housing slots 90, as shown in FIG. 2, and the upper end of the connecting link 100 pivots about the pin 106. Rear tilt of the seat support assembly 12 about the tube 28 is permitted, but is limited by the resilient restraining force of the rear tilt torque mechanism 34 and further limited by the compression springs 80. Adjustment of the rear tilt torque mechanism is basically the same as discussed in U.S. Pat. No. 4,718,726.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A support mechanism for a tiltable chair including a seat support assembly adapted to be mounted to the underside of a chair seat, said support assembly having a front end and a rear end and including a pair of side plates; a tube having a central axis supported between and towards the front ends of said side plates such that said tube is relatively rotatable within said side plates; a base member having a rear end which is adapted to be supported by a chair post and a front end which is rigidly secured about said tube; a rear tilt torque mechanism associated with said seat support assembly operative to resist rear tilt of said seat support assembly about said tube; a rear tilt torque adjustment means connected to said rear tilt torque mechanism to selectively vary the resistance to rear tilt; at least one compression spring disposed between said seat support assembly and said base member operative to provide added resistance to rear tilt of said seat support assembly about said tube; a connecting link having one end pivotally connected to said support assembly and another end slidably connected to said base member, said connecting link adapted to limit rotation of said support assembly about said tube within predetermined limits; a release mechanism associated with said connecting link operative to lock said link in a first position such that rear tilt of said support assembly is prohibited and to selectively release said link to assume a second position such that rear tilt of said support assembly about said tube is permitted within predetermined limits.

2. The support mechanism of claim 1 wherein said connecting link includes an outwardly-extending, angled protrusion.

3. The support mechanism of claim 2 wherein said release mechanism includes a wand having a stop member defining an angled lock surface, said lock surface movable into and out of engagement with said connecting link protrusion such that when said lock surface is moved into engagement with said protrusion rear tilt of said support assembly is prohibited and when said lock surface is moved out of engagement with said protrusion rear tilt of said support assembly is permitted.

4. The support mechanism of claim 1 wherein said rear tilt torque mechanism includes a first torsion bar and a second torsion bar, said first torsion bar extending through said tube, one end of said first torsion bar non-rotatably supported within one end of said tube and the other end rotatably supported within said seat support assembly, said other end of said first torsion bar connectable to a first bracket, said second torsion bar extending between and rotatably supported between the rear ends of said side plates and having one end connectable to a second bracket, said first and second brackets interlockable such that said first and second torsion bars cooperate to resist rear tilt of said seat support assembly about said tube.

5. The support mechanism of claim 1 wherein said rear tilt torque adjustment means includes a bracket, one end of which is attachable to one of said first or second torsion bars and the other end of which defines a collar adapted to receive a threaded element, a tip of which contacts an underside of a flange depending outwardly from a corresponding side plate of said seat support assembly, a knob associated with said threaded element whereby when said knob is rotated, the resistance to rear tilt is adjusted.

6. The support mechanism of claim 1 wherein said compression springs between said seat support assembly and said base member are readily removable and replaceable so as to allow interchangeable use of compression springs of different rates and loads to thereby vary the rear torque resistant force.

* * * * *